United States Patent [19]

Logan

[11] 4,173,853

[45] Nov. 13, 1979

[54] MODULAR CHURCH STEEPLE

[76] Inventor: Gilbert J. Logan, 502 S. 12th St., Leesburg, Fla. 32748

[21] Appl. No.: 937,042

[22] Filed: Aug. 28, 1978

[51] Int. Cl.[2] ..... E04H 12/00

[52] U.S. Cl. ..... 52/57; 52/301; 52/726

[58] Field of Search ..... 52/57, 110, 82, 219, 52/300, 301, 721, 724, 725, 726, 727, 728

[56] References Cited

U.S. PATENT DOCUMENTS

| | | | |
|---|---|---|---|
| 3,031,041 | 4/1962 | Pfaff | 52/726 X |
| 3,209,669 | 10/1965 | Bayne | 52/219 X |
| 3,270,480 | 9/1966 | Beecker | 52/721 X |
| 3,377,765 | 4/1968 | Greeley | 52/726 |
| 3,793,794 | 2/1974 | Archer et al. | 52/724 X |
| 3,842,557 | 10/1974 | Brown | 52/301 |
| 4,069,626 | 1/1978 | Schuette | 52/57 |

*Primary Examiner*—J. Karl Bell

*Attorney, Agent, or Firm*—Duckworth, Hobby, Allen & Pettis

[57] ABSTRACT

A modular church steeple apparatus has a plurality of stackable modular spire units, which can be stacked one within the other for shipment, along with a mast, broken down cupola and base, and coupling and fastening members. The modular spire units can be attached onto the elongated mast and coupled to each other with spacing diaphragm plates between, and pinned and bolted together. The entire steeple can be assembled at the church site, attached to the church roof, and a cupola and base mounted thereto.

20 Claims, 8 Drawing Figures

MODULAR CHURCH STEEPLE

BACKGROUND OF THE INVENTION

The present invention relates to church steeples and especially to modular church steeples which are manufactured and shipped in a modular form and assembled at the church site, but which meet the wind-load criteria of more conventional steeples.

DESCRIPTION OF THE PRIOR ART

It has been conventional in recent years to pre-fabricate steeples of fiberglass or other materials in a plant for shipment to a church, where they are installed on top of the church. These pre-fabricated steeples are generally shipped directly from the factory, inasmuch as the large size makes it difficult to ship and store.

Typical prior U.S. Patents of interest include: U.S. Pat. Nos. 2,564,061 for a daylight sun illuminated cross and tower; 2,670,818 for a method of erecting cupola structures, having the structure built around a central beam; 3,747,287 for a modular building construction using reinforced concrete walls and a roof panel; and 3,994,108 for a tower structure in which a tower is formed around a central chimney. Finally, U.S. Pat. No. 3,953,949 teaches a pre-fabricated modular building structure of a teepee form which is constructed of pre-fabricated, cored panels assembled on the site, using interlocking connections at the peripheral extremities of the floor. The building also has a monolithic cap which is attached to a base assembly by a threaded rod coupled at opposing ends to the cap and to the base assembly for locking the cap onto the base.

In contrast to the prior art, the present invention has a spire, that itself is fastened directly to the roof, formed of a plurality of modular spire units, each adapted to fit one in the other in a compact manner for shipping and storage, and which may be assembled over a metal mast.

A cupola and/or base is assembled around the spire once the spire is mounted onto a church roof. Advantageously, this reduces the shipping and storage space required, yet provides a structure meeting required wind-load criteria.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
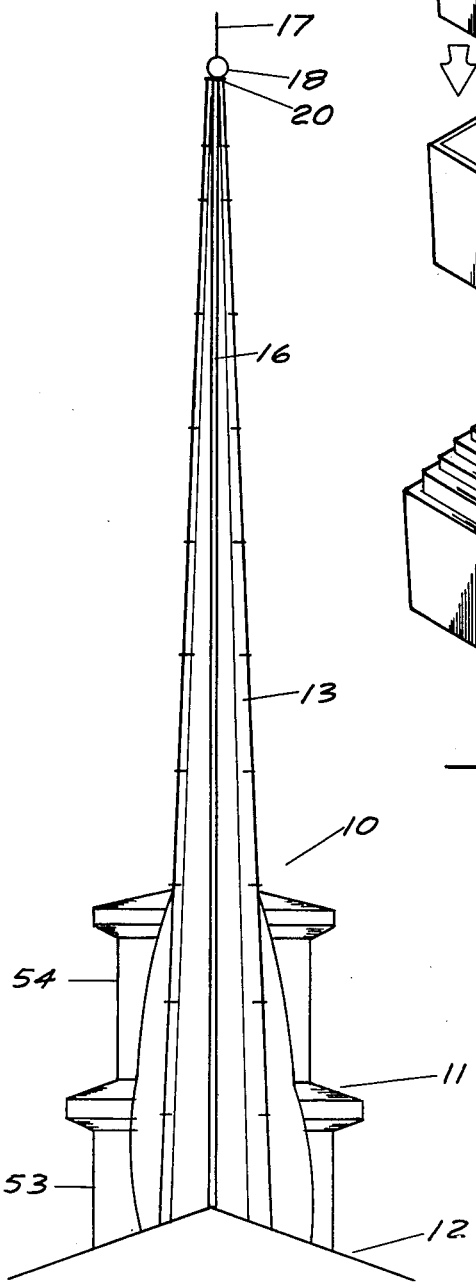
FIG. 1 is a cutaway side elevation of a church steeple in accordance with the present invention.
Figure 3:
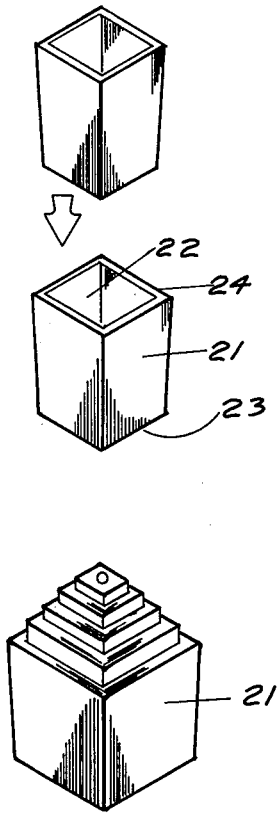
FIG. 3 is a perspective view of the collapsed and packed modular spire units illustrating the removal of modular spire units.
Figure 2:
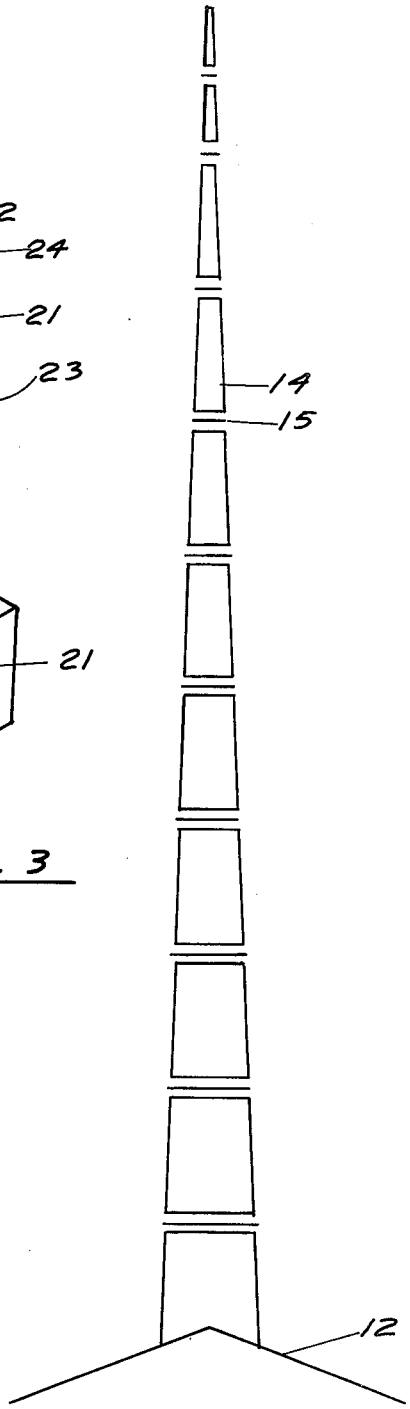
FIG. 2 is an exploded view of the spire of the steeple of FIG. 1.
Figure 5:
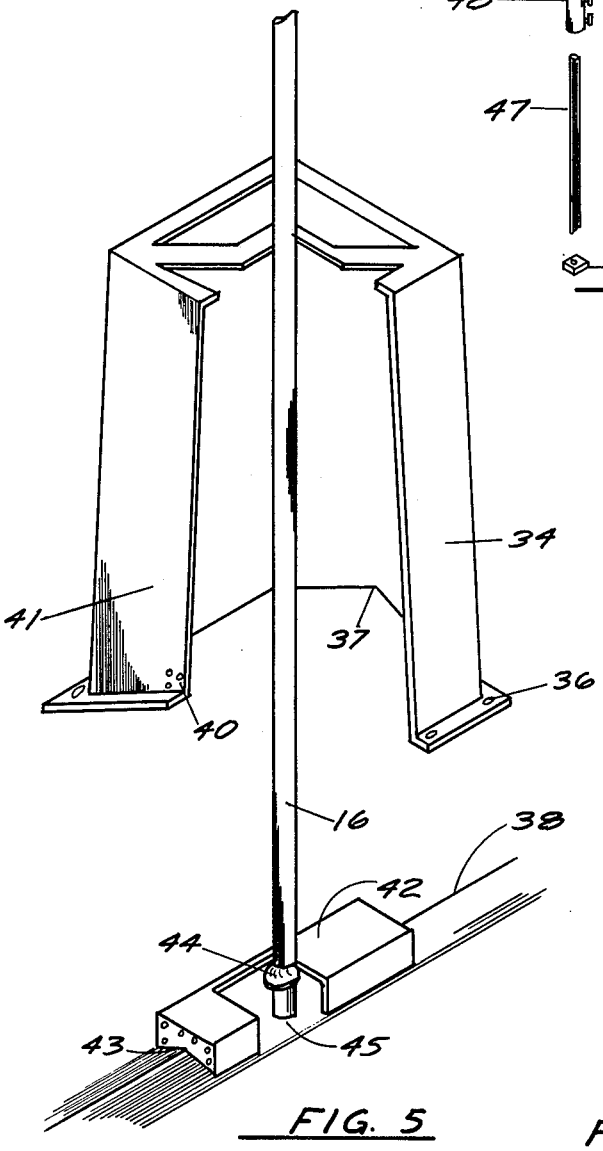
FIG. 5 is a cutaway perspective of the mounting portion for the spire.
Figure 4:
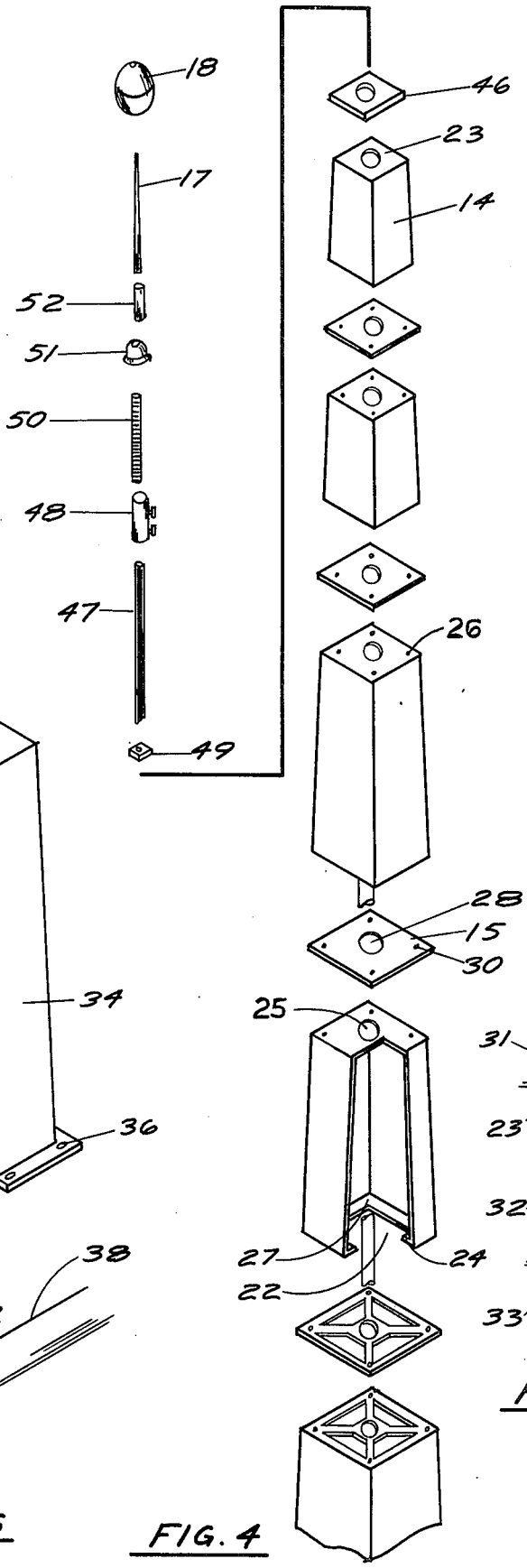
FIG. 4 is an exploded perspective view of a portion of the spire assembly.

Referring to the drawings, and especially to FIGS. 1 through 3, a church steeple 10 is illustrated having a cupola and base 11 and mounted to a roof 12. The steeple 10 has a spire 13 having a plurality of modular spire units 14, each separated by a diaphragm plate 15. The spire is mounted over a mast 16 and directly to the church roof. The mast might be a metal rod, such as an aluminum alloy pipe, and might have a lightning point 17 protruding above a ball 18 mounted adjacent a compression nut 49. The modular spire units 14 are manufactured as separate units of a material such as fiberglass formed in metal molds, and each has one or more sides 21, a bottom 22, and a top 23. The bottom 22 is open, except for a flange 24, so that when turned upside down, as illustrated in FIG. 3, each smaller modular spire unit 14 will fit into the next larger modular spire unit bottom opening 22, so that they all may be stacked into one compact collapsed container, as illustrated in FIG. 3. The modular spire units may be shipped and stored in this condition, and would be shipped along with the mast 16, the diaphragm plates 15, the cupola 11, which is disassembled and the other components to form the complete steeple 10. The spire may be assembled on the ground, or on the roof and then mounted to the roof.

Figure 6:
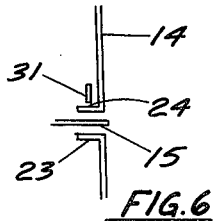
FIG. 6 is an exploded sectional view of the attachment of modular spire units together.
Figure 7:
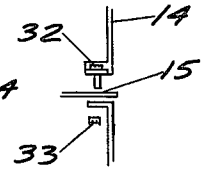
FIG. 7 is an exploded sectional view of a second attachment of modular spire units together.

The assembly is more clearly illustrated in connection with FIGS. 4 through 7, in which each modular spire unit 14 has a mast opening 25 in the top 23 and a plurality of small openings 26 mounted at each corner of the top 23 and a plurality of openings 27 mounted on the flange 24 of the bottom 22. Each diaphragm plate 15 has a mast opening 28 and a plurality of openings 30 positioned for the openings 26 in the top 23 and the openings 27 in the bottom flange 24. Since the modular spire units 14 get progressively smaller as they go up the steeple spire, it will be clear that each diaphragm plate 15 fits between a predetermined pair of adjacent modular spire units. The spire units are held together, as shown in FIG. 6, by a pin 31 passing through the opening 27 in the bottom flange 24 through an opening 30 in the diaphragm plate 15 and into the opening 26 on the top 23 of the next lower modular unit 14. Pins 31 maintain the modular spire units 14 in alignment and held together, inasmuch as the modular spires 14 are all held onto the mast 16 from the top and bottom of the mast 16, as explained in more detail hereinafter. The bottom-most spire units 14 may be held with a bolt 32 found with flange 27 and locked with a nut 33 as illustrated in FIG. 7. A bottom, or base, spire unit 34 is similar to spire units 14 except that it has flange 35 having a plurality of openings 36 for mounting the base spire unit 34 to the roof 12. In addition, the base spire modular unit 34 has an inverted V-shape 37 on the bottom thereof for fitting on the ridge 38 of the roof 12. In addition, it has a plurality of side openings 40 through two sides 41 of the spire module 34. A ridge plate 42 similarly has an inverted V-shape 43 for fitting onto the ridge 38 of the roof 12 and is bolted through the openings 40 to the spire base 34. The ridge plate 42 has an opening therein for the mast 16 to fit into and has a washer nut 44 locked with a compression fitting 45 threadedly attached to the base of the mast 16. The washer nut 44 can ride on the ridge plate 42 and is locked in place with a compression fitting 45 which also locks the mast 16 to the base spire 34. The base spire, in turn, is bolted to the next spire modular unit 14 and the remaining spire units are pinned and/or bolted together with inter-spaced diaphragm plates 15. It should be noted that the flange 27 and the corners of the spire units 14 are thicker than the side, thereby forming a molded framework and avoiding the necessity of additional frame members.

The spire units 14 are locked to the top of the mast by a compression cap 46 which fits onto the topmost spire modular unit 14 top 23 and may have a lightning cable 47 passing therethrough and locked with a clamp 48. A threaded extension rod 50 is attached to the clamp 48 and passes through a compression cap nut 51 which may have a coupling for a lightning point 52 attached thereto. The lightning point 17 may be mounted to the coupling 52 and the ball covering 18 slid thereover to cover up the compression cap 51 and tip of the coupling 52, as shown in FIG. 1. The cable 47, the clamp 48 and extension piece 50 would be mostly inside the mast 16. These units, of course, all fit together, and allow a lightning cable 47 to pass through the mast 16 and through the roof 12 or off to one side through the base spire unit 34. The spire unit is assembled at the church site by mounting each of the modular spire units 14 with inter-spaced diaphragm plates 15 to a mast 16 in the appropriate order, with the base unit 34 at the bottom, and each progressively smaller spire unit 14 mounted thereover. The ridge plate 42 is mounted to the base unit 34 through the openings 40 and the compression fitting 45 locks the washer nut 44 to the ridge plate 42. Once all of the spire units 14 are mounted and the lightning cable 47 is passed through the mast 16, a cap nut 49 is mounted over the lightning cable 47 and clamped with a cable clamp 48, the extension 50 is added to the clamp 48, the compression cap 51 mounted thereover, the coupling 52 mounted thereto and the lightning point 17 and ball 18 mounted onto the top of the spire. The assembled spire unit is then raised onto the roof 12 to extend over the ridge 38 and is attached to the roof with lag bolts or the like through the openings 36 in the flange 35.

Figure 8:
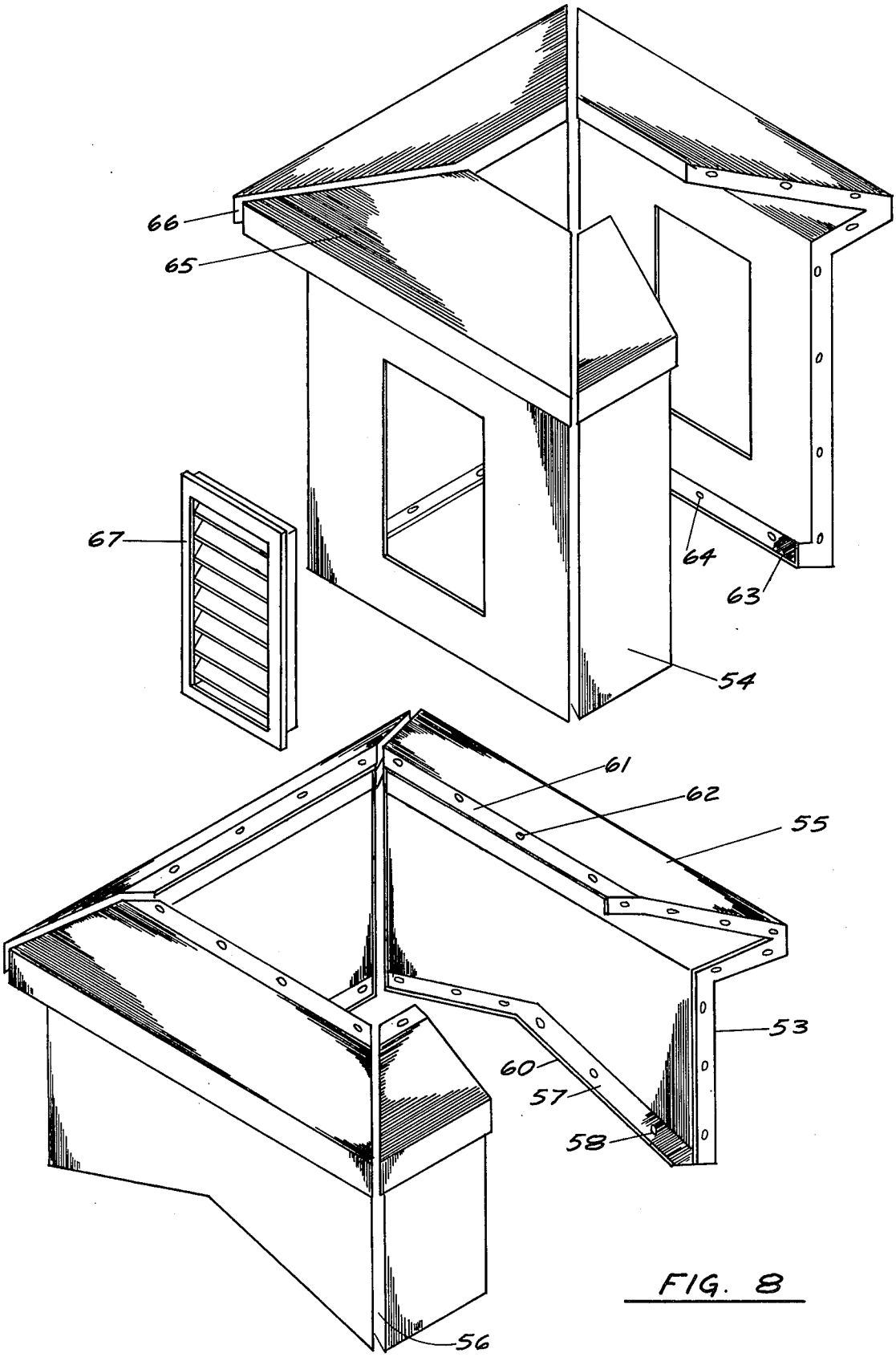
FIG. 8 is an exploded fragmentary perspective of a cupola and base for the steeple.

Once the spire is attached to the roof, the cupola, as illustrated in FIG. 8, can be assembled around the bottom portion of the spire as shown in the cutaway of FIG. 1. The cupola has a base 53 and cupola 54. The base has a plurality of side walls 55, each bolted together at a mitered joint 56. Each side 56 has an inside flange 57 having a plurality of openings 58 for bolting to the roof 12 over the ridge 38 with the ridge shaped flange 57 having an inverted V-shape with a point 60. With the base assembled, the cupola 54 can be mounted to a top ledge 61 having a plurality of openings 62 therein with the cupola flanges 63 having a plurality of openings 64, and the walls 65 of the cupola 54 can be attached at a mitered corner 66. Louvered windows 67 can be attached, or can be provided already mounted to the walls 65 and shipped. Thus the cupola and cupola base are mounted to add the additional decorative feature to the church steeple. These units can also be made of fiberglass, if desired, or can be made of other materials such as plywood or aluminum without departing from the spirit and scope of the invention.

It should be observed at this point that the diaphragm plates 15 assist in the coupling of the modular spire units 14 together, but also protrude approximately 3/16ths of an inch out from the edge of the modular spire units, addng an additional decorative feature, if desired, and also avoiding the close tolerance alignments that might otherwise be required. The diaphragms, of course, can be made smooth and allow the pins 31 of FIG. 6 to hold the spire modules together, which are also attached at the top through the compression cap 46 and at the bottom through the ridge plate 42 and compression fitting 45, which compresses all of the modular spire units together, and held in alignment by the pins 31 or bolts 32. The modular spires might typically be formed of fiberglass reinforced polyester resin, while the diaphragm plates 15 might be of a thermoplastic polymer material. The mast 16 can be made of an aluminum alloy or other metal if desired, while the lightning cable 47 is a commercially available copper aluminum cable.

Advantageously, individual spire units 14 or portions of the cupola or base can be replaced, in the event of damage, without having to replace the entire steeple. Also, any shape desired may be used with or without additional embellishments without departing from the scope of the invention. For instance, a cross can be placed on top of the spire.

Accordingly, the present invention is not to be construed as limited to the particular forms disclosed herein, which are to be regarded as illustrative rather than restrictive.

I claim:

1. A modular church steeple comprising in combination:

a plurality of stackable modular spire units, each of a different size from the other spire units, and each shaped to fit at least partially into the next larger spire unit through an opening in the bottom of the next larger spire unit, and each spire unit top having a mast opening therein;

an elongated mast for assembly of each modular spire unit thereonto, said mast extending through said bottom opening and through said top mast opening of each modular spire unit;

coupling means for coupling each spire unit to the adjacent spire unit along said elongated mast;

cap means for attaching to said mast top to lock said modular spire unit onto said mast; and means to attach said mast and attached modular spire units onto a roof, whereby a modular church steeple has stackable modular spire units which may be easily assembled into a steeple spire.

2. A church steeple in accordance with claim 1, in which said plurality of stackable modular spire units has a base spire unit and a ridge plate attachable to said base modular spire unit, said base spire unit and ridge plate adapted to fit onto the ridge of a roof.

3. The modular church steeple in accordance with claim 2, in which said mast has a bottom fastener means for attaching said mast to said ridge plate attached to said base spire unit.

4. The modular church steeple in accordance with claim 3, in which said coupling means includes a plurality of diaphragm plates, each plate shaped to fit between two adjacent modular spire units and each having a mast opening through the center portion thereof and a plurality of fastener openings.

5. The modular church steeple in accordance with claim 4, in which said coupling means includes a plurality of pins and/or bolts adapted to be fitted through a plurality of openings in the bottom of one modular spire unit through an opening in said diaphragm plate and through an opening in the top of the next adjacent bottom modular spire unit.

6. A modular church steeple in accordance with claim 5, in which said coupling means includes bolts and nuts for coupling said base spire unit to the next adjacent spire unit and an intermittent diaphragm plate.

7. A modular church steeple in accordance with claim 6, which has a cupola having a plurality of sides removably attachable to each other for assembly around a spire attached to a roof.

8. A modular church steeple in accordance with claim 7, in which said cupola has a cupola base and a cupola top, each having a plurality of removably attachable sides and having means for attaching said cupola top to said cupola base, and said cupola base having means for attaching said cupola to a roof.

9. A modular church steeple in accordance with claim 8, in which said mast has a lightning point attached to the end thereof.

10. A modular church steeple in accordance with claim 9, in which a lightning cable is mounted through said mast to said lightning point and is attached with a clamp above said mast.

11. The modular church steeple in accordance with claim 10, in which said cap means includes a compression cap for attaching to said mast for applying pressure to the topmost modular spire unit.

12. The church steeple in accordance with claim 11, in which each of said plurality of modular spire units are formed of fiberglass reinforced polymer resins and said diaphragm plates are formed of a polymer material.

13. A modular church steeple in accordance with claim 12, in which said base modular spire unit and said ridge plate have inverted V bottom surface for attaching to the ridge of a roof and said cupola base has an inverted V-shape for attaching over the ridge of a roof.

14. A modular church steeple in accordance with claim 13, in which each said modular spire unit has a generally truncated pyramid shape.

15. The modular church steeple in accordance with claim 1, having each of said plurality of stackable modular spire units having corners and a base flange of a thickness greater than the side thereof to form a framework therein.

16. A method of making a modular church steeple comprising the steps of:

forming a plurality of stackable modular spire units, each having a top and bottom with a mast opening in the top and an opening in the bottom;

forming a plurality of diaphragm plates;

forming a base modular spire unit shaped to fit onto a roof ridge;

forming a ridge plate formed to fit on a roof ridge and to be attached to said base modular spire unit;

attaching each of said plurality of modular spire units and diaphragm plates to said mast with each successively smaller spire unit being attached onto a diaphragm plate of predetermined size and onto the next larger modular spire unit to form a narrowing spire.

17. The method in accordance with claim 16, in which each modular spire unit is attached to the other with a plurality of pins and bolts connecting each adjacent pair of spire units and said pair of diaphragm plates.

18. The method in accordance with claim 17, including the step of assembling and attaching a cupola around said spire unit to the roof of a building.

19. The method in accordance with claim 18, including the step of locking the top of said mast under pressure against the topmost modular spire unit.

20. The method in accordance with claim 19, including the step of locking the bottom portion of the mast to the ridge plate attached to said base spire unit.

* * * * *